US005429913A

United States Patent [19]

Merkel et al.

[11] Patent Number: 5,429,913

[45] Date of Patent: * Jul. 4, 1995

[54] PHOTOGRAPHIC COUPLER COMPOSITIONS CONTAINING BALLASTED ALCOHOLS AND METHODS

[75] Inventors: Paul B. Merkel, Rochester; Edward Schofield, Penfield, both of N.Y.

[73] Assignee: Eastman Kodak Company, Rochester, N.Y.

[ * ] Notice: The portion of the term of this patent subsequent to Aug. 30, 2011 has been disclaimed.

[21] Appl. No.: 113,012

[22] Filed: Aug. 30, 1993

Related U.S. Application Data

[63] Continuation of Ser. No. 611,807, Nov. 13, 1990, now abandoned.

[51] Int. Cl.[6] ..... G03C 7/38; G03C 7/392; G03C 7/388

[52] U.S. Cl. ..... 430/386; 430/387; 430/449; 430/487; 430/546; 430/550; 430/558

[58] Field of Search ..... 430/543, 546, 550, 558, 430/554, 555, 386, 387, 376, 407, 464, 449

[56] References Cited

U.S. PATENT DOCUMENTS

| | | | |
|---|---|---|---|
| 2,768,894 | 10/1956 | Harriman et al. | 430/546 |
| 2,835,579 | 5/1958 | Thirtle et al. | 430/546 |
| 3,788,857 | 1/1974 | Van Poucke et al. | 430/546 |
| 4,419,441 | 12/1983 | Nittel et al. | 430/377 |
| 4,686,177 | 8/1987 | Aoki et al. | 430/553 |
| 4,774,166 | 9/1988 | Sasaki et al. | 430/376 |
| 4,857,449 | 8/1989 | Ogawa et al. | 430/546 |
| 4,970,139 | 11/1990 | Bagchi | 430/546 |
| 5,006,453 | 4/1991 | Takahashi et al. | 430/546 |
| 5,008,179 | 4/1991 | Chari et al. | 430/546 |
| 5,176,989 | 1/1993 | Morigaki et al. | 430/505 |
| 5,200,303 | 4/1993 | Takahashi et al. | 430/546 |
| 5,342,746 | 8/1994 | Zengerle et al. | 430/546 |

FOREIGN PATENT DOCUMENTS

| | | |
|---|---|---|
| 137722 | 4/1985 | European Pat. Off. . |
| 143570 | 6/1985 | European Pat. Off. . |
| 145342 | 6/1985 | European Pat. Off. . |
| 56-041098 | 9/1981 | Japan . |

OTHER PUBLICATIONS

Abstract 61-075349, Apr. 17, 1986, Japan.
EP 0276319 Abstract, Claims, and Pages 102-114.

*Primary Examiner*—Lee C. Wright
*Attorney, Agent, or Firm*—Gordon M. Stewart

[57] ABSTRACT

Photographic coupler compositions comprise a magenta dye-forming coupler and an alcohol in an amount sufficient to increase the activity of the dye-forming coupler. The alcohol is of the formula wherein $R_1$ is selected from the group consisting of (a) unsubstituted alkyl and alkenyl groups, (b) alkyl groups containing one or more substitutents selected from the group consisting of aryl groups, alkenyl groups, halogen atoms, alkoxy groups, alkoxy carbonyl groups and acyloxy groups, (c) unsubstituted aryl groups and (d) aryl groups containing one or more substituents selected from the group consisting of alkyl groups, alkoxy groups, alkoxy carbonyl groups and acyloxy groups; and $R_2$ and $R_3$ are individually selected from hydrogen and the group of moieties from which R is selected, provided that the total number of carbon atoms contained in $R_1$, $R_2$ and $R_3$ is at least 10.

21 Claims, No Drawings

PHOTOGRAPHIC COUPLER COMPOSITIONS CONTAINING BALLASTED ALCOHOLS AND METHODS

This application is a continuation of application Ser. No. 07/611,807 filed Nov. 13, 1990, now abandoned.

FIELD OF THE INVENTION

The present invention relates to photographic compositions which comprise a dye-forming coupler and a ballasted alcohol which increases the activity of the dye-forming coupler. The invention also relates to color photographic materials including such coupler compositions, methods for increasing the activity of dye-forming couplers in color photographic developing processes, and methods for the formation of color images, which methods employ the novel coupler compositions.

BACKGROUND OF THE INVENTION

It is well known in the color photography art that color images are produced by a colored dye which is formed by a coupling reaction between an oxidized product of an aromatic primary amine color developing agent and a coupler. Various types of cyan, magenta and yellow dye-forming couplers are well known for use in such coupling reactions. The couplers are often used in combination with one or more solvents and/or other additives. For example, the Thirtle et al U.S. Pat. No. 2,835,579 discloses photographic emulsions comprising couplers in combination with alkylphenol or acylphenol coupler solvents. Similarly, Japanese Reference No. 61-075349 discloses photographic silver halide emulsion layers containing a coupler dissolved in a phenolic organic solvent having a high boiling point. The Aoki et al U.S. Pat. No. 4,686,177 discloses silver halide color photographic materials containing a cyan coupler which may be dissolved in an organic solvent. The resulting solution is finely dispersed in water or an aqueous binder for incorporation in the photographic material. Aoki et al broadly disclose numerous organic solvents which may be employed including, among others, alcohols and phenols. The Konishiroku Photo Industry European References Nos. 137,722, 143,570 and 145,342 similarly disclose silver halide color photographic materials which include at least one magenta coupler and a non-color forming phenolic compound such as a phenolic high-boiling organic solvent. Japanese reference No. 81-041098 discloses silver halide color photographic light sensitive materials prepared using cyan coupler compounds dispersed and emulsified in solvents having a boiling point greater than 200° C. and saturated alcohols of the formula ROH wherein R is a 9 to 18 carbon containing saturated unbranched aliphatic group.

It is often desirable in color photography to provide the coupler compounds with improved coupler activity. As employed herein, the term improved coupler activity relates to the improved colorability of a coupler as indicated, for example, by the acceleration of the reaction of the coupler with the oxidized developer in forming the colored dye and/or by an increase in the color density of the resulting colored dye. For example, the Sasaki et al U.S. Pat. No. 4,774,166 broadly discloses numerous compounds for use as coloration accelerators for couplers which result in a reduction in the photographic processing time. Sasaki et al disclose that preferred coloration accelerators comprise phenolic compounds, oxyalkylene compounds and hydroxy substituted, 5- to 7- membered heterocyclic ring compounds.

Many coupler compositions, however, are disadvantageous in that relatively large amounts of a coupler are required to provide satisfactory color density, the reaction rate of the coupler with the oxidized developer is unacceptably low, the coupler exhibits unacceptably high sensitivity to the pH of the developer solution and/or the like. Accordingly, a continuing desire exists for coupler compositions of improved activity for use in color photographic materials and methods.

SUMMARY OF THE INVENTION

Accordingly, it is an object of the present invention to provide novel coupler compositions for use in color photography. It is a more specific object to provide coupler compositions which exhibit improved coupler activity wherein improved coupler activity is indicated by an increased color density in a colored dye formed from the coupler composition and/or a reduced sensitivity to the pH of the developer solution in the coupler reaction to form the colored dye. It is a further object of the present invention to provide coupler compositions which exhibit improved coupler activity as indicated by an increase in the color density of the dye resulting from reaction of the coupler composition, without causing significant bathochromic hue shifts in the colored dye. It is a related object of the invention to provide methods for increasing the activity of coupler compounds in color photography. Additional objects of the invention also include the provision of improved silver halide color photographic materials and improved methods for the formation of color images.

These and additional objects are provided by the photographic coupler compositions of the present invention which comprise a magenta dye-forming coupler and an alcohol in an amount sufficient to increase the activity of the dye-forming coupler. Specifically, the alcohol is of the formula

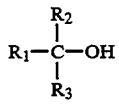

wherein $R_1$ is selected from the group consisting of (a) unsubstituted alkyl and alkenyl groups, (b) alkyl groups containing one or more substitutents selected from the group consisting of aryl groups, alkenyl groups, halogen atoms, alkoxy groups, alkoxy carbonyl groups and acyloxy groups, (c) unsubstituted aryl groups and (d) aryl groups containing one or more substituents selected from the group consisting of alkyl groups, alkoxy groups, alkoxy carbonyl groups and acyloxy groups; and $R_2$ and $R_3$ are individually selected from hydrogen and the group of moieties from which $R_1$ is selected, provided that the total number of carbon atoms contained in $R_1$, $R_2$ and $R_3$ is at least 10.

It has been discovered that the alcohol employed in the coupler compositions of the present invention provides the magenta dye-forming coupler with increased activity as indicated by an increase in the color density of the colored dye formed therefrom, particularly without causing significant bathochromic hue shifts in the dye, and/or by reducing the sensitivity of the coupler compound to the pH of the developer solution in the formation of the colored dye. Thus, the alcohol is employed in combination with the magenta dye-forming coupler in order to increase the dye-forming coupler's activity. The coupler compositions of the present invention are therefore suitable for use in improved silver halide color photographic materials and in improved methods for the formation of color images.

These and additional advantages will be more fully apparent in view of the following detailed description.

DETAILED DESCRIPTION

The photographic coupler compositions of the present invention comprise a dye-forming coupler, preferably a magenta dye-forming coupler, and an alcohol in an amount sufficient to increase the activity of the dye-forming coupler. An increase in the activity of the dye-forming coupler is evidenced by an improved color density of the colored dye formed from the coupler, particularly without causing significant bathochromic hue shifts in the colored dye, and/or by a reduction in the sensitivity of the dye-forming reaction of the coupler to the pH of the developer solution. The increased activity exhibited by the coupler compositions of the present invention allows reductions in the amounts of coupler compounds which are employed in photographic materials and/or provides developed color images of improved quality.

The alcohols which are employed in the coupler compositions of the present invention are generally described as ballasted alcohols and may be employed either as solvents for the coupler compounds and/or as non-solvent additives. It is important that the alcohols contain sufficient ballast to minimize their volatility and water solubility. Alcohols suitable for use in the coupler compositions of the present invention are of the formula

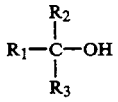

wherein $R_1$ is selected from the group consisting of (a) unsubstituted alkyl and alkenyl groups, (b) alkyl groups containing one or more substitutents selected from the group consisting of aryl groups, alkenyl groups, halogen atoms, alkoxy groups, alkoxy carbonyl groups and acyloxy groups, (c) unsubstituted aryl groups and (d) aryl groups containing one or more substituents selected from the group consisting of alkyl groups, alkoxy groups, alkoxy carbonyl groups and acyloxy groups; and $R_2$ and $R_3$ are individually selected from hydrogen and the group of moieties from which $R_1$ is selected, provided that the total number of carbon atoms contained in $R_1$, $R_2$ and $R_3$ is at least 10. Preferably, the total number of carbon atoms contained in $R_1$, $R_2$ and $R_3$ is from 10 to about 30.

In a preferred embodiment, $R_1$ is a substituted or unsubstituted alkyl group or a substituted or unsubstituted alkenyl group. In additionally preferred embodiments, at least one of $R_2$ and $R_3$ is hydrogen and/or at least one of $R_2$ and $R_3$ is a substituted or unsubstituted alkyl group or a substituted or unsubstituted alkenyl group. For example, when $R_1$ is a straight-chain or branched alkyl group and $R_2$ and $R_3$ are hydrogen, the alcohol is of the formula $C_mH_{2m+1}$—OH, with m preferably being an integer of from 10 to about 30. When $R_1$ and $R_2$ are individually straight-chain or branched alkyl groups and $R_3$ is hydrogen, the alcohol is of the formula $C_nH_{2n+1}CH(C_mH_{2m+1})OH$, with n+m preferably being in the range of from 9 to about 29. When $R_1$ is a straight-chain or branched alkenyl group and $R_2$ and $R_3$ are hydrogen, the alcohol is of the formula $(C_nH_{2n+1})CH{=}CH(CH_2)_mCH_2{-}OH$, with n+m preferably being from 7 to about 27. When $R_1$ is an aryl-substituted alkyl group and $R_2$ and $R_3$ are hydrogen, the alcohol is of the formula $(C_6H_5)C_nH_{2n}OH$, with n preferably being from 4 to about 24. In an additional embodiment, $R_1$ may be a substituted or unsubstituted aryl group, preferably with at least one of $R_2$ and $R_3$ being hydrogen.

Specific examples of suitable ballasted alcohols for use in the coupler compositions of the present invention include, but are not limited to, the following compounds $n{-}C_{12}H_{25}OH$ (a-i)

$n{-}C_{16}H_{33}OH$ (a-ii)

$CH_3CH(OH)(CH_2)_9CH_3$ (a-iii)

$CH_3(CH_2)_7CH{=}CH(CH_2)_8OH$ (a-iv)

(a-v)

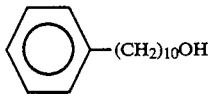

$(CH_3)_2C{=}CHCH_2CH_2C(CH_3){=}CHCH_2CH_2C(CH_3)(OH)CH{=}CH_2$ (a-vi)

$C_8H_{17}CH(C_6H_{13})CH_2OH$ (a-vii)

$C_{10}H_{21}CH(C_8H_{17})CH_2OH$ (a-viii)

$(CH_3)_2CHCH_2CH(OH)CH_2CH_2CH(C_2H_5)(CH_2)_3CH_3$ (a-ix)

As noted above, the ballasted alcohol employed in the coupler compositions of the present invention may act as a solvent for the dye-forming coupler. One or more additional organic solvents for the coupler compound may also be employed in the compositions of the present invention. Generally, conventional organic coupler solvents are known in the art and may be employed when the ballasted alcohol of the present invention is used in an additive amount which is not sufficient to result in a solution of the coupler compound. Examples of conventional organic solvents which may be used in the present compositions are described in the Examples set forth below.

The ballasted alcohol is employed in the coupler compositions of the present invention in an amount sufficient to increase the activity of the dye-forming coupler. In most applications, it is preferred that the dye-forming coupler and the alcohol are employed in a weight ratio of from about 1:0.1 to about 1:10 in order to effect an increase in the activity of the dye-forming coupler.

As noted above, it is preferred that the dye-forming coupler included in the present coupler compositions comprises a magenta dye-forming coupler. Couplers which form magenta dyes upon reaction with oxidized color developing agents are well known in the art and are described in such representative patents and publications as: U.S. Pat. Nos. 2,600,788; 2,369,489; 1,969,479; 2,311,082; 3,061,432; 3,725,067; 4,120,723; 4,500,630; 2,343,703; 2,311,082; 3,152,896; 3,519,429; 3,062,653; 2,908,573; 4,774,172; 4,443,536; 3,935,015; 4,540,654; 4,581,326; European Patent Applications 284,239; 284,240; 240,852; 170,164; 177,765 and "Farbkuppler-eine Literaturübersicht," published in Agfa Mitteilungen, Band III, pp. 126–156 (1961), the disclosures of which are incorporated herein by reference.

Preferred magenta dyed-forming couplers comprise pyrazoloazole compounds of the general formula

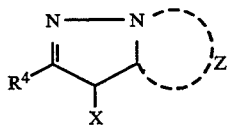

when $R^4$ i s hydrogen, substituted or unsubstituted alkyl, substituted or unsubstituted phenyl, substituted or unsubstituted alkoxy, substituted or unsubstituted amino or anilino, substituted or unsubstituted acylamino or halogen, or a group which links to a polymer, x is hydrogen or a coupling-off group and Z is a heterocyclic ring. Particularly preferred pyrazoloazole magenta couplers comprise pyrazole or triazole compounds of the formulae M-I and M-II and pyrazolobenzimidizoles of formula M-III:

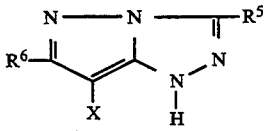

(M-I)

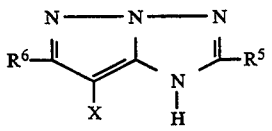

(M-II)

and

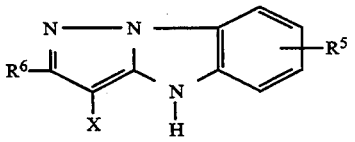

(M-III)

wherein each of $R^5$ and $R^6$ are individually selected from hydrogen, substituted and unsubstituted alkyl, substituted and unsubstituted phenyl, substituted and unsubstituted alkoxy, substituted and unsubstituted amino or anilino, substituted and unsubstituted acylamino and halogens or are a group which links to a polymer. X is hydrogen or a coupling-off group. Coupling-off groups are well known to those skilled in the photographic art. Generally, such groups determine the equivalency of the coupler and modify the reactivity of the coupler. Coupling-off groups can also advantageously effect the layer in which the coupler is coated or others layers in the photographic material by performing, after release from the coupler, such functions as development inhibition, bleach acceleration, color correction, development acceleration and the like. Representative coupling-off groups include halogens (for example, chloro), alkoxy, aryloxy, alkyl thio, aryl thio, acyloxy, sulfonamido, carbonamido, arylazo, nitrogen-containing heterocyclic groups such as pyrazolyl and imidazolyl, and imido groups such as succinimido and hydantoinyl groups. Except for the halogens, these groups may be substituted if desired. Coupling-off groups are described in further detail in: U.S. Pat. Nos. 2,355,169; 3,227,551; 3,432,521; 3,476,563; 3,617,291; 3,880,661; 4,052,212 and 4,134,766, and in British Patent References Nos. 1,466,728; 1,531,927; 1,533,039; 2,006,755A and 2,017,704A, the disclosures of which are incorporated herein by reference.

As is well known in the photographic art, a coupler compound should be nondiffusible when incorporated in a photographic element. That is, the coupler compound should be of such a molecular size and configuration that it will exhibit substantially no diffusion from the layer in which it is coated.

To achieve this result, the total number of carbon atoms contained in $R^5$ and $R^6$ should be at least 10 or $R^5$ or $R^6$ should serve as a link to or form part of a polymeric chain.

In a particularly preferred embodiment of the coupler compositions of the present invention, the magenta dye-forming coupler has an in-film $pH_{\frac{1}{2}}$ value greater than or equal to about 10.0, which is the pH of a typical developer solution. The $pH_{\frac{1}{2}}$ value is defined as the pH of a solution at which half of the coupler molecules are ionized, i.e., deprotonated, at the coupling site when a film containing the coupler is immersed in the solution. The ballasted alcohols employed in the compositions of the present invention have been determined to be particularly suitable for improving the activity of such magenta dye-forming couplers.

Suitable magenta dye-forming couplers for use in the present invention include, but are not limited to, the following compounds:

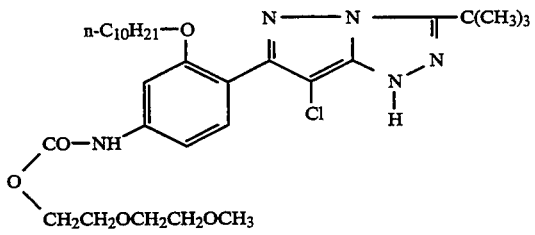

(m-i)

-continued
(m-ii)
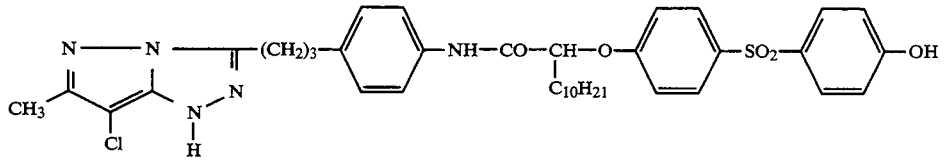
(m-iii)
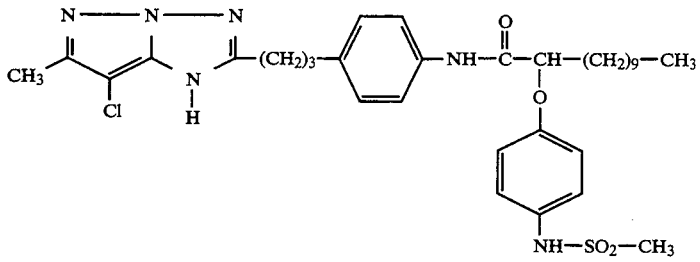
(m-iv)
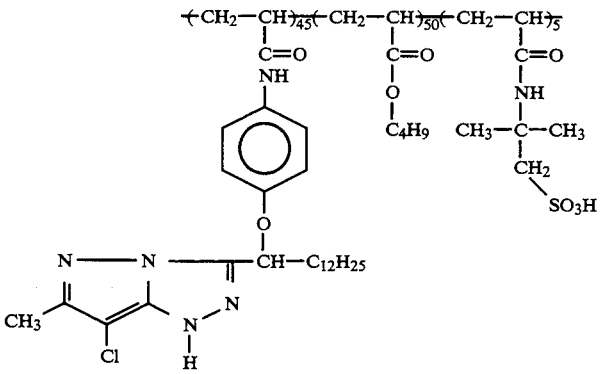
(m-v)
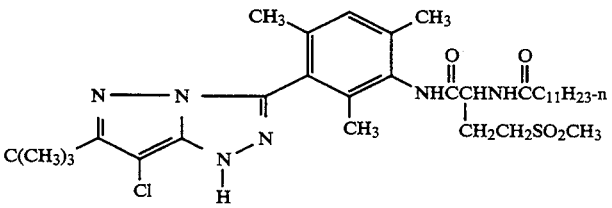
(m-vi)
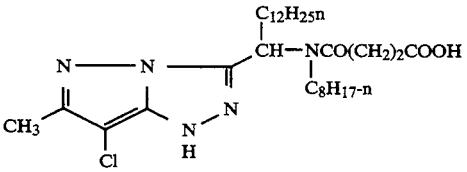
(m-vii)
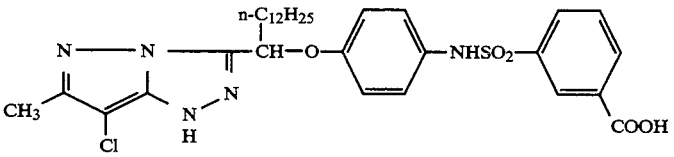
(m-viii)
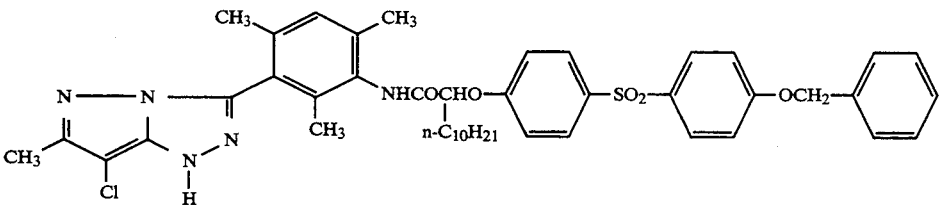

-continued (m-ix)

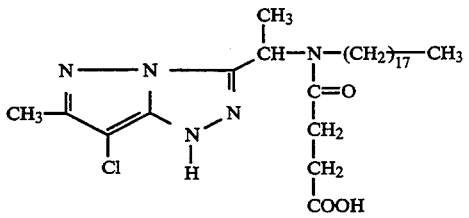

(m-x)

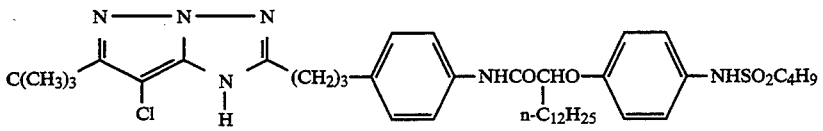

(m-xi)

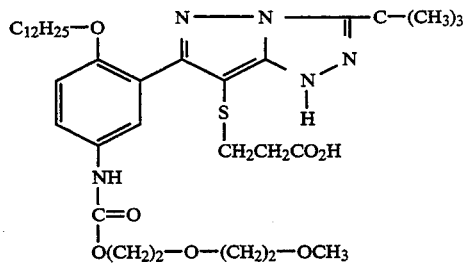

(m-xii)

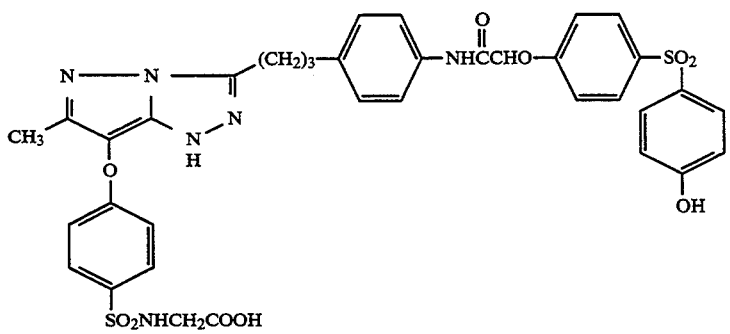

(m-xiii)

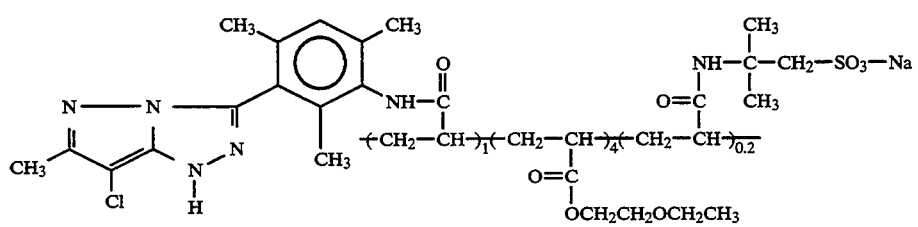

(m-xiv)

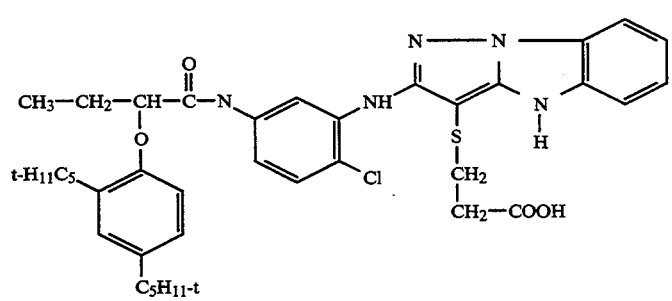

The photographic coupler compositions according to the present invention are employed in color photographic materials in a manner well known in the color photographic art. For example, a supporting substrate is coated with a silver halide emulsion and the coupler composition of the present invention comprising a magenta dye-coupler and a ballasted alcohol in an amount sufficient to increase the activity of the dye-forming coupler. The photographic material is then imagewise exposed in a manner well known in the color photography art followed by development with an aromatic primary amine developer. As is well known in the art, the oxidation product of the aromatic primary amine developer reacts with the coupler compound to form the colored dye images.

The compositions and methods of the present invention are demonstrated by the following Examples in which references are to parts by weight unless otherwise specified. Additionally, the following conventional coupler solvents were employed in the Examples for comparative purposes:

| | |
|---|---|
| mixed tritolyl phosphates | (cs-xi) |
| dibutyl phthalate | (cs-xii) |
| N,N-diethyldodecanamide | (cs-xiii) |
| p-dodecylphenol | (cs-xiv) |
| 2,4-di-t-pentylphenol | (cs-xv) |

EXAMPLE 1

Coupler compositions comprising emulsion dispersions of coupler compound (m-i) set forth above were prepared using the ballasted alcohol (a-iv) according to the present invention as a coupler solvent and using conventional coupler solvents for comparison purposes as described in Table I. Specifically, an oil base was prepared by warming a mixture of 1.3 g of the coupler compound (m-i), 0.65 g or 1.3 g of the respective coupler solvent and 3.9 g of ethyl acetate until dissolution was complete. The compositions containing 0.65 g of the coupler solvent had a 1:0.5 weight ratio of coupler compound to solvent while the compositions which contained 1.3 g of coupler solvent had a coupler compound to solvent weight ratio of 1:1. Each resulting oil phase was added to an aqueous phase consisting of 35.7 g of a 12.5% aqueous gelatin solution, 4.47 g of 10% Alkanol XC and 28.4 g of water. Each resulting mixture was warmed to approximately 45° C. and passed through a colloid mill three times to disperse the oil phase in the aqueous phase. The resulting dispersions were coated on transparent cellulose acetate butyrate supports at a level of approximately $1.5\times10^{-4}$ moles/ft$^2$ (93 mg/ft$^2$) together with a silver bromoiodide emulsion containing about 6% iodide, in the following format:

| | |
|---|---|
| Gelatin | 250 mg/ft$^2$ |
| BVSM Hardener | 2% of total gelatin |
| Saponin | 1.46% |
| Gelatin | 350 mg/ft$^2$ |
| Coupler (m-i) | 93 mg/ft$^2$ |
| Ag Emulsion | 84.2 mgAg/ft$^2$ |
| Saponin | 1.46% |
| Support | |

The resulting hardened films were exposed through a step tablet on a sensitometer and then subjected to an E-6 commercial development process employing citrazinic acid (CZA) while additional films were subjected to a similar development process which did not contain the citrazinic acid. After processing, the maximum density (Dmax) value of each film strip was measured through a green filter and the spectral absorption maxima (λmax) at densities of approximately 1.0 of the films were measured on a spectrophotometer. The resulting data is set forth in Table I.

TABLE I

| Coupler Solvent | Coupler: Solvent weight ratio | Dmax (with CZA) | Dmax (w/out CZA) | λmax (nm) |
|---|---|---|---|---|
| (a-iv)-invention | 1:0.5 | 2.65 | 4.02 | 553 |
| (a-iv)-invention | 1:1 | 3.17 | 4.13 | 551 |
| (cs-xi)-conventional | 1:0.5 | 1.56 | 2.93 | 552 |
| (cs-xi)-conventional | 1:1 | 1.55 | 2.79 | 550 |
| (cs-xii)-conventional | 1:0.5 | 1.86 | 3.30 | 552 |
| (cs-xii)-conventional | 1:1 | 2.06 | 3.43 | 550 |
| (cs-xv)-conventional | 1:0.5 | 1.90 | 3.27 | 553 |
| (cs-xv)-conventional | 1:1 | 2.55 | 3.73 | 554 |

The results set forth in Table I demonstrate that use of the ballasted alcohol according to the present invention as a coupler solvent increased the activity of the coupler compound, as evidenced by a significantly increased maximum color density, Dmax, as compared with the coupler compositions which contained conventional coupler solvents. Additionally, the results set forth in Table I demonstrate that use of the coupler composition according to the present invention employing the ballasted alcohol exhibited a smaller degree of undesirable bathochromic hue shift, as indicated by λmax, in the composition containing a 1:1 weight ratio of coupler to solvent as compared with the use of the conventional coupler solvent which provided the closest Dmax, namely, the coupler composition employing the conventional coupler solvent (cs-xv).

EXAMPLE 2

Coupler compositions comprising emulsion dispersions of magenta coupler compound (m-ii) as described above were prepared using various ballasted alcohols according to the present invention as coupler solvents and using conventional coupler solvents as set forth in Table II. The resulting coupler compositions contained a weight ratio of coupler compound to coupler solvent of 1:0.5. Specifically, an oil phase was prepared by warming a mixture of 3.4 g of the coupler compound (m-ii), 1.7 g of the respective coupler solvent and 10.2 g of an auxiliary solvent comprising 2-(2-butoxyethoxy)ethyl acetate until dissolution was complete. The resulting solution was added to an aqueous phase solution containing 18.13 g of a 12.5% aqueous gelatin solution, 2.7 g of 10% aqueous Alkanol XC and 2.08 g of water. Each resulting mixture was passed through a colloid mill three times to disperse the oil phase and was then chilled, noodled and washed for four hours at 40° C. to remove the auxiliary solvent. Each dispersed coupler composition was then coated on a cellulose acetate butyrate support at a level of $1.5\times10^{-4}$ moles/ft$^2$(108 mg/ft$^2$) together with a sensitized silver bromoiodide emulsion containing 12% iodide, in the following format:

| | |
|---|---|
| Gelatin | 250 mg/ft$^2$ |
| Hardener | 1.75% of total gel |
| Gelatin | 350 mg/ft$^2$ |
| Coupler (m-ii) | $1.5\times10^{-4}$ mole/ft$^2$ |
| Ag Emulsion | 84.2 mg/ft$^2$ |
| Tetraazaindine | 35 mg/mole Ag |
| Support | |

Hardened film strips of the coated supports were exposed through a step wedge of a sensitometer (1/25 sec) and subjected to a Kodak Flexicolor® (C-41) color development process Green densities of the processed films were read using a densitometer and λmax values were measured on a spectrophotometer. The coupler solvents were evaluated in two separate coating sets, A and B. The contrast or photographic gamma, measured on the straight line portion of the density versus exposure curve, and λmax values are set forth in Table II.

TABLE II

| | Coupler Solvent | Gamma | λmax (nm) |
|---|---|---|---|
| Set A: | (a-iv)-invention | 2.50 | 555.3 |
| | (cs-xi)-conventional | 1.60 | 555.3 |
| | (cs-xii)-conventional | 1.80 | 555.6 |
| | (cs-xiv)-conventional | 3.08 | 558.2 |
| Set B: | (a-i)-invention | 2.21 | 556.4 |
| | (a-ii)-invention | 2.08 | 557.8 |
| | (a-iii)-invention | 2.09 | 556.5 |
| | (a-iv)-invention | 2.27 | 556.5 |
| | (a-v)-invention | 2.17 | 557.1 |
| | (a-vi)-invention | 2.09 | 557.6 |
| | (cs-xi)-conventional | 1.80 | 556.9 |
| | (cs-xii)-conventional | 1.57 | 556.3 |

The results set forth in Table II demonstrate that the coupler compositions containing the ballasted alcohols according to the present invention provided the photographic materials with substantially larger gamma values as compared with the coupler compositions containing conventional coupler solvents such as compounds (cs-xi) and (cs-xii). Additionally, unlike the conventional phenolic coupler solvent, use of the ballasted alcohols according to the present invention produced only small bathochromic hue shifts. Thus, the coupler compositions of the present invention are particularly useful when it is desirable to improve coupler activity while also maintaining dye hue. For example, as demonstrated in Set A, use of the ballasted alcohol (a-iv) according to the present invention as compared with use of the conventional coupler solvent (cs-xii) increased the gamma value from 1.6 to 2.5 while the λmax is the same for both compositions. It is also noted that while use of the conventional coupler solvent (cs-xiv) provided a large increase in the gamma value, it also produced an undesirably large bathochromic hue shift of nearly 3 nm relative to the use of other compounds.

EXAMPLE 3

Coupler compositions comprising dispersions of the coupler compound (m-iii) as set forth above were prepared using a ballasted alcohol according to the present invention (a-iv) as a coupler solvent and using various conventional coupler solvents. The coupler compound and the respective coupler solvent were employed in a weight ratio of 1:1. Specifically, an oil phase comprising 0.90 g of the coupler compound (m-iii), 0.90 g of coupler solvent and 2.70 g of an auxiliary solvent comprising 2-(2-butoxyethoxy)ethyl acetate was added to an aqueous phase comprising 7.20 g of a 12.5% aqueous gelatin solution, 0.90 g of Alkanol XC and 2.40 g of water. The mixture was passed through a colloid mill to disperse the oil phase. Each resulting dispersion was then coated on a transparent cellulose acetate butyrate support at a level of $1.0\times10^{-4}$ moles/ft$^2$ (65.7 mg/ft$^2$) together with 84.2 mg/ft$^2$ of a silver bromoiodide emulsion containing 12% iodide, in the following format:

| | |
|---|---|
| Gelatin | 250 mg/ft$^2$ |
| Hardener | 1.75% of total gel |
| Gelatin | 350 mg/ft$^2$ |

-continued

| | |
|---|---|
| Coupler (m-iii) | 65.7 mg/ft$^2$ |
| Coupler Solvent | 65.7 mg/ft$^2$ |
| Ag Emulsion | 84.2 mg/ft$^2$ |
| Tetraazaindine | 35 mg/mole Ag |
| Support | |

Hardened film strips of the coated support were exposed and processed as described in Example 2. Gamma values obtained from plots of the status M green density versus the exposure and λmax values from absorption spectra at a density of approximately 1.0 were determined and are set forth in Table III.

TABLE III

| Coupler Solvent | Gamma | λmax (nm) |
|---|---|---|
| (a-iv)-invention | 0.92 | 558.3 |
| (cs-xi)-conventional | 0.58 | 556.3 |
| (cs-xii)-conventional | 0.69 | 556.2 |
| (cs-xiv)-conventional | 1.37 | 569.0 |

The results set forth in Table III demonstrate that use of the coupler composition according to the present invention containing the ballasted alcohol compound (a-iv) provides a substantial improvement in gamma value relative to use of the conventional coupler compositions containing solvents (cs-xi) and (cs-xii), while simultaneously providing only a slight increase in λmax. Moreover, while use of a coupler composition containing the phenolic coupler solvent (cs-xiv) provided significant improvements in gamma value, this composition also provided an unacceptably large bathochromic hue shift of 13 nm relative to the other compositions.

EXAMPLE 4

Coupler compositions comprising emulsion dispersions of the polymeric magenta coupler compound (m-iv) as described above and a ballasted alcohol according to the present invention as a coupler solvent or various conventional coupler solvents were prepared. The coupler compositions contained a coupler compound to coupler solvent weight ratio of 1:0.5. Specifically, dispersions were prepared by milling 0.3 g of the respective coupler solvent and 1.1 g ethyl acetate with 15 ml of a 12.5% aqueous gelatin solution, 1.9 ml of 10% aqueous Alkanol XC and 9.1 ml of water. Each resulting coupler solvent dispersion was then added to a latex dispersion of the polymeric coupler compound (m-iv) in an amount to provide the coupler compound to coupler solvent weight ratio of 1:0.5. The resulting mixtures were stirred for three hours at 40° C. to permit loading of the coupler solvent into the latex. The resulting coupler solvent-containing latex dispersions of the polymeric coupler compound were then coated on a transparent cellulose acetate butyrate support at a level of $1.0\times10^{-4}$ moles/ft$^2$ with a sensitized silver bromoiodide emulsion containing 12% iodide, in the following format:

| | |
|---|---|
| Gelatin | 250 mg/ft$^2$ |
| Hardener | 1.75% of total gel |
| Gelatin | 350 mg/ft$^2$ |
| Coupler (m-iv) | $1.0\times10^{-4}$ mole/ft$^2$ |
| Coupler Solvent | 1:0.5 (w/w) |
| Ag Emulsion | 84.2 mg/ft$^2$ |
| Tetraazaindine | 35 mg/mole Ag |

-continued

| Support |
|---|

Hardened film samples of the coated supports were exposed and processed according to the procedures described in Example 2. The status M green gamma values were obtained as described in the previous examples and are set forth in Table IV.

TABLE IV

| Coupler Solvent | Gamma |
|---|---|
| (a-iv)-invention | 0.96 |
| (cs-xi)-conventional | 0.67 |
| (cs-xii)-conventional | 0.86 |
| (cs-xiii)-conventional | 0.49 |

The results set forth in Table IV demonstrate that the use of the coupler composition according to the present invention containing the ballasted alcohol as a coupler solvent provided a significantly improved gamma value as compared with the use of the coupler compositions containing conventional coupler solvents.

Similar coupler compositions containing additional ballasted alcohols according to the present invention were used to prepare color films which exhibited similar improvements in gamma values and/or Dmax, with little or no significant bathochromic hue shifts in the resulting colored dyes.

The preceding examples are set forth to illustrate specific embodiments of the invention and are not intended to limit the scope of the compositions and methods of the present invention. Additional embodiments and advantages within the scope of the claimed invention will be apparent to one of ordinary skill in the art.

What is claimed is:

1. A photographic coupler composition, comprising a magenta dye-forming coupler, and an alcohol in an amount sufficient to increase the activity of the dye-forming coupler, the alcohol being of the formula

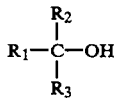

wherein $R_1$ is selected from the group consisting of (a) unsubstituted alkyl and unsubstituted alkenyl groups, (b) substituted alkyl groups and substituted alkenyl groups, wherein said substituents are selected from the group consisting of aryl groups, alkenyl groups, halogen atoms, alkoxy carbonyl groups and acyloxy groups, (c) unsubstituted aryl groups and (d) substituted aryl groups wherein said substituents are selected from the group consisting of alkyl groups, alkoxy groups, alkoxy carbonyl groups and acyloxy groups; and $R_2$ and $R_3$ are individually selected from hydrogen and the group of moieties from which $R_1$ is selected, provided that the total number of carbon atoms contained in $R_1$, $R_2$ and $R_3$ is at least 10, and the magenta dye-forming coupler being of a formula selected from the group consisting of

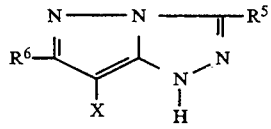

(M-I)

and

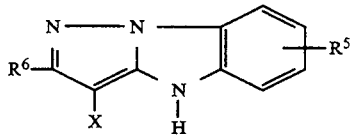

(M-III)

wherein each of $R^5$ and $R^6$ are individually selected from the group consisting of hydrogen, substituted and unsubstituted alkyl, substituted and unsubstituted phenyl, substituted and unsubstituted alkoxy, substituted and unsubstituted amino, substituted and unsubstituted anilino, substituted and unsubstituted acylamino, halogens and a group which links to a polymer, provided that the total number of carbon atoms contained in $R^5$ and $R^6$ is at least 10 when neither $R^5$ or $R^6$ is a group which links a polymer, and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups.

2. A photographic coupler composition as defined by claim 1, wherein $R_1$ is selected from the group consisting of the substituted and the unsubstituted alkyl groups and the substituted and the unsubstituted alkenyl groups.

3. A photographic coupler composition as defined by claim 2, wherein at least one of $R_2$ and $R_3$ is hydrogen.

4. A photographic coupler composition as defined by claim 2, wherein at least one of $R_2$ and $R_3$ is selected from the group of $R_1$ moieties consisting of the substituted and the unsubstituted alkyl groups and the substituted and the unsubstituted alkenyl groups.

5. A photographic coupler composition as defined by claim 2, wherein one of $R_2$ and $R_3$ is hydrogen and the other of $R_2$ and $R_3$ is selected from the group of $R_1$ moieties consisting of the substituted and the unsubstituted alkyl groups and the substituted and the unsubstituted alkenyl groups.

6. A photographic coupler composition as defined by claim 11, wherein $R_1$ is selected from the group consisting of the substituted and the unsubstituted alkyl groups and the substituted and the unsubstituted alkenyl groups, at least one of $R_2$ and $R_3$ is hydrogen, the other of $R_2$ and $R_3$ is hydrogen or is selected from the group of $R_1$ moieties consisting of the substituted and the unsubstituted alkyl groups and the substituted and the unsubstituted alkenyl groups, and the total number of carbon atoms in $R_1$, $R_2$ and $R_3$ is from 10 to about 30.

7. A photographic coupler composition as defined by claim 1, wherein $R_1$ is selected from the group consisting of the substituted and the unsubstituted aryl groups.

8. A photographic coupler composition as defined by claim 7, wherein at least one of $R_2$ and $R_3$ is hydrogen.

9. A photographic coupler composition as defined by claim 1, wherein the total number of carbon atoms in $R_1$, $R_2$ and $R_3$ is from 10 to about 30.

10. A photographic coupler composition as defined by claim 1, wherein the dye-forming coupler and the alcohol are included in a weight ratio of from about 1:0.1 to about 1:10.

11. A photographic coupler composition as defined by claim 1, wherein the composition further includes a third component comprising an organic solvent.

12. A photographic coupler composition as defined by claim 1, wherein the magenta dye-forming coupler has an in-film $pH_{\frac{1}{2}}$ of not less than about 10.0.

13. A photographic coupler composition as defined by claim 1, wherein $R_1$ is an unsubstituted alkyl group, an aryl-substituted alkyl group, an unsubstituted alkenyl group or an unsubstituted aryl group, and $R_2$ and $R_3$ are each hydrogen, an unsubstituted alkyl group, an aryl-substituted alkyl group, an unsubstituted alkenyl group or an unsubstituted aryl group.

14. A color photographic material, comprising a supporting substrate coated with a silver halide emulsion and a coupler composition comprising a magenta dye-forming coupler and an alcohol in an amount sufficient to increase the activity of the dye-forming coupler, the alcohol being of the formula

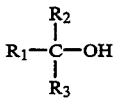

wherein $R_1$ is selected from the group consisting of (a) unsubstituted alkyl and unsubstituted alkenyl groups, (b) substituted alkyl groups and substituted alkenyl groups wherein said substituents are selected from the group consisting of aryl groups, alkenyl groups, halogen atoms, alkoxy carbonyl groups and acyloxy groups, (c) unsubstituted aryl groups and (d) substituted aryl groups wherein said substituents are selected from the group consisting of alkyl groups, alkoxy groups, alkoxy carbonyl groups and acyloxy groups; and $R_2$ and $R_3$ are individually selected from hydrogen and the group of moieties from which $R_1$ is selected, provided that the total number of carbon atoms contained in $R_1$, $R_2$ and $R_3$ is at least 10, and the magenta dye-forming coupler being of a formula selected from the group consisting of

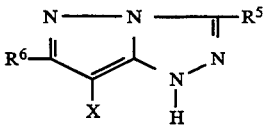

(M-I)

and

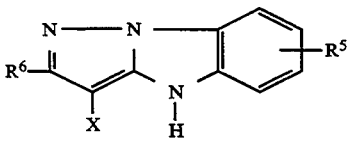

(M-III)

wherein each of $R^5$ and $R^6$ are individually selected from the group consisting of hydrogen substituted and unsubstituted alkyl, substituted and unsubstituted phenyl, substituted and unsubstituted alkoxy, substituted and unsubstituted amino, substituted and unsubstituted anilino, substituted and unsubstituted acylamino, halogens and a group which links to a polymer, provided that the total number of carbon atoms contained in $R^5$ and $R^6$ is a least 10 when neither $R^5$ nor $R^6$ is a group which links to a polymer, and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups.

15. A color photographic material as defined by claim 14, wherein $R_1$ is selected from the group consisting of the substituted and the unsubstituted alkyl groups and the substituted and the unsubstituted alkenyl groups.

16. A color photographic material as defined by claim 30, wherein at least one of $R_2$ and $R_3$ is selected from the group of $R_1$ moieties consisting of the substituted and the unsubstituted alkyl groups and the substituted and the unsubstituted alkenyl groups.

17. A color photographic material as defined by claim 14, wherein $R_1$ is selected from the group consisting of the substituted and the unsubstituted aryl groups.

18. A color photographic material as defined by claim 14, wherein the total number of carbon atoms in $R_1$, $R_2$ and $R_3$ is from 10 to about 30.

19. A color photographic material as defined by claim 14, wherein $R_1$ is an unsubstituted alkyl group, an aryl-substituted alkyl group, an unsubstituted alkenyl group or an unsubstituted aryl group, and $R_2$ and $R_3$ are each hydrogen, an unsubstituted alkyl group, an aryl-substituted alkyl group, an unsubstituted alkenyl group or an unsubstituted aryl group.

20. A method for increasing the activity of a magenta dye-forming coupler in a color photographic developing process, comprising providing the dye-forming coupler in a photographic layer in combination with an alcohol, the alcohol being included in an amount sufficient to increase the activity of the dye-forming coupler and being of the formula

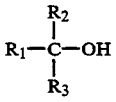

wherein $R_1$ is selected from the group consisting of (a) unsubstituted alkyl and unsubstituted alkenyl groups, (b) substituted alkyl groups and substituted alkenyl groups, wherein said substituents are selected from the group consisting of aryl groups, alkenyl groups, halogen atoms, alkoxy carbonyl groups and acyloxy groups, (c) unsubstituted aryl groups and (d) substituted aryl groups wherein said substituents are selected from the group consisting of alkyl groups, alkoxy groups, alkoxy carbonyl groups and acyloxy groups; and $R_2$ and $R_3$ are individually selected from hydrogen and the group of moieties from which $R_1$ is selected, provided that the total number of carbon atoms contained in $R_1$, $R_2$ and $R_3$ is at least 10, and the magenta dye-forming coupler being of a formula selected from the group consisting of

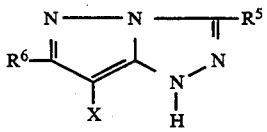

(M-I)

and

-continued (M-III)

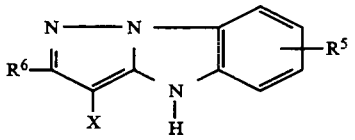

wherein each of $R^5$ and $R^6$ are individually selected from the group consisting of hydrogen substituted and unsubstituted alkyl, substituted and unsubstituted phenyl, substituted and unsubstituted alkoxy, substituted and unsubstituted amino, substituted and unsubstituted anilino, substituted and unsubstituted acylamino, halogens and a group which links to a polymer, provided that the total number of carbon atoms contained in $R^5$ and $R^6$ is a least 10 when neither $R^5$ nor $R^6$ is a group which links to a polymer, and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups.

21. A method for the formation of color images, comprising (A) imagewise exposing a photographic layer, and (B) developing the exposed image, wherein the photographic layer comprises a silver halide emulsion and a coupler composition comprising (i) a magenta dye-forming coupler, and (ii) an alcohol in an amount sufficient to increase the activity of the dye-forming coupler, the alcohol being of the formula

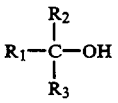

wherein $R_1$ is selected from the group consisting of (a) unsubstituted alkyl and unsubstituted alkenyl groups, (b) substituted alkyl groups and substituted alkenyl groups, wherein said substituents are selected from the group consisting of aryl groups, alkenyl groups, halogen atoms, alkoxy carbonyl groups and acyloxy groups, (c) unsubstituted aryl groups and (d) substituted aryl groups wherein said substituents are selected from the group consisting of alkyl groups, alkoxy groups, alkoxy carbonyl groups and acyloxy groups; and $R_2$ and $R_3$ are individually selected from hydrogen and the group of moieties from which $R_1$ is selected, provided that the total number of carbon atoms contained in $R_1$, $R_2$ and $R_3$ is at least 10, and the magenta dye-forming coupler being of a formula selected from the group consisting of (M-I)

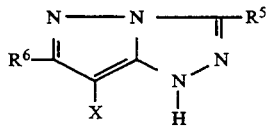

and (M-III)

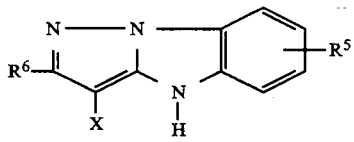

wherein each of $R^5$ and $R^6$ are individually selected from the group consisting of hydrogen substituted and unsubstituted alkyl, substituted and unsubstituted phenyl, substituted and unsubstituted alkoxy, substituted and unsubstituted amino, substituted and unsubstituted anilino, substituted and unsubstituted acylamino, halogens and a group which links to a polymer, provided that the total number of carbon atoms contained in $R^5$ and $R^6$ is a least 10 when neither $R^5$ nor $R^6$ is a group which links to a polymer, and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups.

* * * * *

UNITED STATES PATENT AND TRADEMARK OFFICE

CERTIFICATE OF CORRECTION

PATENT NO. : 5,429,913

DATED : July 4, 1995

INVENTOR(S) : Paul B. Merkel et al.

It is certified that error appears in the above-indentified patent and that said Letters Patent is hereby corrected as shown below:

Column 16, claim 6, line 2, following the word "claim" delete [11] and insert --1--.

Column 18, claim 16, line 11, delete [30] and insert --15--..

Signed and Sealed this

Fourteenth Day of May, 1996

*Attest:*

Bruce Lehman

BRUCE LEHMAN

*Attesting Officer*

*Commissioner of Patents and Trademarks*